US007665725B2

(12) United States Patent
Bridges et al.

(10) Patent No.: US 7,665,725 B2
(45) Date of Patent: Feb. 23, 2010

(54) REGISTRATION GATE FOR MULTI SHEET INSERTER TRAY

(75) Inventors: Richard Thomas Calhoun Bridges, London (GB); Roy Norman Gladwin, Aylesbury (GB)

(73) Assignee: Xerox Corporation, Norwalk, CT (US)

( * ) Notice: Subject to any disclaimer, the term of this patent is extended or adjusted under 35 U.S.C. 154(b) by 141 days.

(21) Appl. No.: 11/656,068

(22) Filed: Jan. 22, 2007

(65) Prior Publication Data

US 2008/0174063 A1 Jul. 24, 2008

(51) Int. Cl.
*B65H 3/52* (2006.01)

(52) U.S. Cl. ..... 271/124; 271/121; 271/122

(58) Field of Classification Search ..... 271/122, 271/121, 120, 244, 245, 124
See application file for complete search history.

(56) References Cited

U.S. PATENT DOCUMENTS

| | | | | |
|---|---|---|---|---|
| 4,606,536 | A | 8/1986 | Ohara | |
| 5,738,453 | A * | 4/1998 | Tsuburaya et al. | 400/624 |
| 6,199,855 | B1 * | 3/2001 | Choeng et al. | 271/122 |
| 6,547,235 | B2 * | 4/2003 | Higaki | 271/10.01 |
| 6,598,873 | B2 * | 7/2003 | Takisawa et al. | 271/246 |
| 6,651,972 | B2 * | 11/2003 | Hsiao et al. | 271/114 |
| 6,651,973 | B2 * | 11/2003 | Gaarder et al. | 271/117 |
| 7,210,677 | B2 * | 5/2007 | Fukumura et al. | 271/10.01 |
| 7,255,339 | B2 * | 8/2007 | Hung et al. | 271/122 |
| 7,398,970 | B2 * | 7/2008 | Morimoto et al. | 271/117 |
| 2001/0040338 | A1 * | 11/2001 | Kuo et al. | 271/245 |
| 2002/0033572 | A1 | 3/2002 | Takisawa | |
| 2005/0035524 | A1 | 2/2005 | Fukumura | |
| 2005/0035534 | A1 * | 2/2005 | Kim et al. | 271/152 |
| 2005/0263955 | A1 * | 12/2005 | Kim | 271/121 |

FOREIGN PATENT DOCUMENTS

| | | | |
|---|---|---|---|
| JP | 60 064942 | U | 5/1985 |
| JP | 61 248829 | A | 11/1986 |

OTHER PUBLICATIONS

European Search Report for EP 08 15 0451, dated Oct. 12, 2009, The Hague.

* cited by examiner

*Primary Examiner*—Patrick H Mackey
*Assistant Examiner*—Luis Gonzalez
(74) *Attorney, Agent, or Firm*—Fay Sharpe LLP

(57) ABSTRACT

A registration gate is mounted in a sheet feeding mechanism for rotation about an axis at about right angles to the direction of sheet feed into a feeder mechanism. The gate includes a plurality of fingers extending upwardly through slots in the tray. A motorized sequencing cam moves followers to rotate the gate to an open position to retract the fingers below the tray, to raise and lower a nudger in and to move a lever for locking and unlocking the gate into the closed position with the fingers upright for registering the leading edge of the sheets during user loading of the tray. The cam may be detented or locked by a pawl engaging a notch in the cam.

12 Claims, 14 Drawing Sheets

REGISTRATION GATE FOR MULTI SHEET INSERTER TRAY

BACKGROUND

The present invention relates to feeder mechanisms for automatically feeding sheets, such as copy paper, into an operating mechanism such as a photocopier, and particularly, relates to sheet feeder mechanisms of the type having an open receptacle or tray loaded by the user for a particular print job. More particularly, the disclosure relates to sheet feeder mechanisms of the aforesaid type where the user needs less than about one hundred sheets of paper in the stack loaded into the feeder.

Heretofore, sheet stack feeder mechanisms, and particularly those employed in photocopiers have encountered problems with the loading and feeding of the sheet stack into the feeder mechanism because of the difficulties in aligning the stack of sheets such that all the sheets in the stack have their leading edge parallel to the feeder rolls and initially have the leading edge of the sheets in the stack aligned vertically with respect to the surface of the tray or receptacle. In sheet stack feeder mechanisms having an open tray for loading the sheets, the user has often encountered difficulty in preventing the sheets in the stack from becoming skewed with respect to the feeder mechanism with the result that the feeder mechanism becomes jammed requiring the user to release the feeder mechanism and removed the jammed sheets. Furthermore, users often push a stack of sheets into the feed mechanism causing multifeeds, e.g. more than one sheet is fed into the machine with no gap between sheets.

Thus, it has been desired to find a way or means of preventing the skewing of sheets loaded into a tray for entry into an automatic sheet feeder mechanism and to prevent skewing and misalignment of the sheets during loading of the tray or receptacle by the user. In particular, it has been desired to provide a way or means for registering the leading edge of the sheets in the stack for proper alignment to enter the feeder mechanism and to prevent multifeeding of sheets.

BRIEF DESCRIPTION

The present disclosure describes apparatus and method for addressing the above described problem of insuring alignment and preventing skewing of sheets loaded by a user into the tray or receptacle for an automatic sheet feeding mechanism. The disclosure describes an exemplary embodiment of a leading edge gate in the sheet stack receptacle or tray which is pivoted about an axis generally parallel to the feeder rolls or at about right angles to the direction of sheet feed into the mechanism. A sequencer rotates the gate to an upright position in which it is locked during the sheet loading operation by the user. Upon the commencement of the automatic feed operation, the gate lock is released and the gate rotated out of the way of the sheet stack thereby enabling automatic feeding of the sheets from the stack into the feeder mechanism.

In the event of a jam in the feeder mechanism, the sequencer enables release of the feeder mechanism for removal of the jammed sheets and retains the gate in the open position. Upon resumption of the sheet feeding operation, the sequencer maintains the gate open until completion of the feed operation, whereupon the gate is automatically reclosed for enabling reloading of sheets in the stack. In the exemplary embodiment disclosed, the sequencer employs a rotating cam which is engaged by a cam follower on the gate for effecting gate rotation. The exemplary embodiment described and illustrated utilizes a gate in the form of a plurality of axially spaced fingers aligned along the axis of rotation and extending at about right angles thereto.

DETAILED DESCRIPTION

Figure 1:
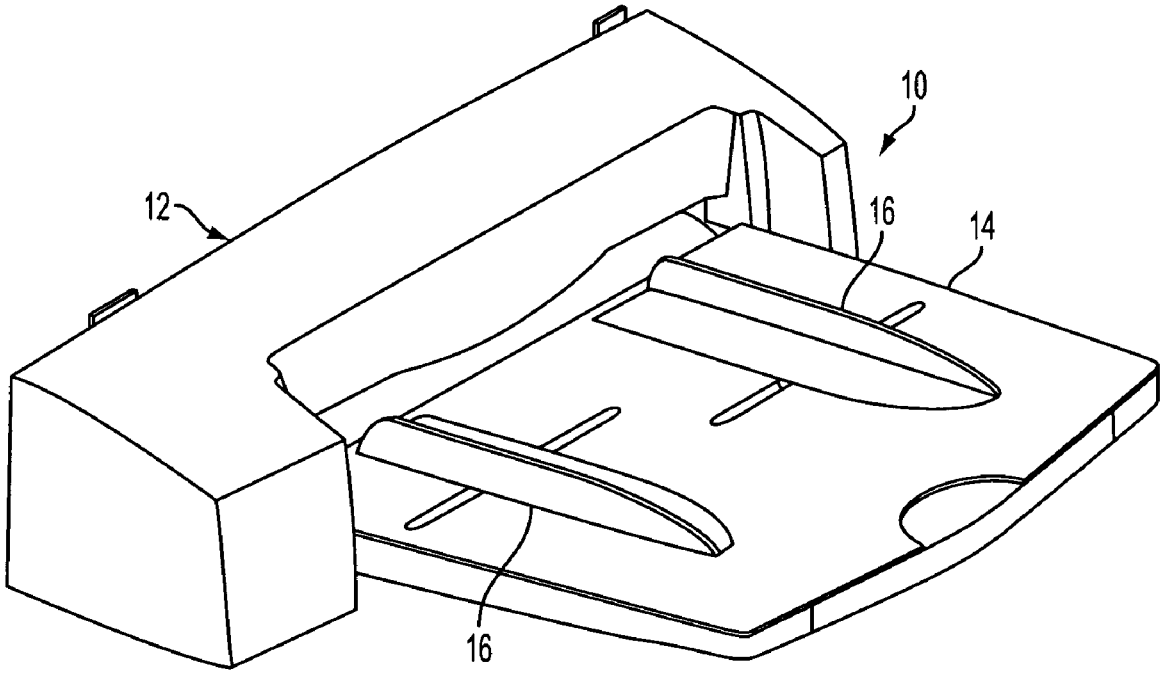
FIG. 1 is a perspective view of an automatic sheet feeder with a receptacle for user loading of the stack of sheets.

Referring to FIGS. 1 through 5, a sheet feeder mechanism indicated generally at 10 is illustrated as having a motorized feeder indicated generally at 12 with a user loadable tray or receptacle 14 having edge guides 16 for aligning the sheets in a user loaded stack.

Referring to FIGS. 2 through 5, the motorized feeder mechanism is illustrated with the cover removed and is indicated generally at 18 and includes a motor 20 which rotates a driven gear 22 through intermediate gears (not shown) in a manner known in the art.

Another gear (not shown) is operative to drive one of the feeder rolls 32 serving as a feed roll; and the pinion 30 drives an idler gear 28 which, in turn, drives pinion 26 which rotates the nudger roll 24. Roller 24 functions as a nudger and roller 32 the feeder.

The driven gear 22 is operative to effect movement of the sequencer indicated generally at 34 which in the presently described exemplary embodiment, comprises a rotary cam. The nudger roller 24 is mounted on a support frame 36 which is pivoted about an axle 38 extending generally at right angles to the direction of sheet feed indicated by the black arrow in FIG. 4; and, the support frame 36 includes a cam follower 40 adjacent an end thereof. The follower 40 is operative to engage or follow a cam track 42 provided on the sequencer 34. As the cam rotates, the follower causes the nudger roll 24 to be raised or lowered toward the retarding pad 25 or media sheet stack placed above it.

Figure 5:
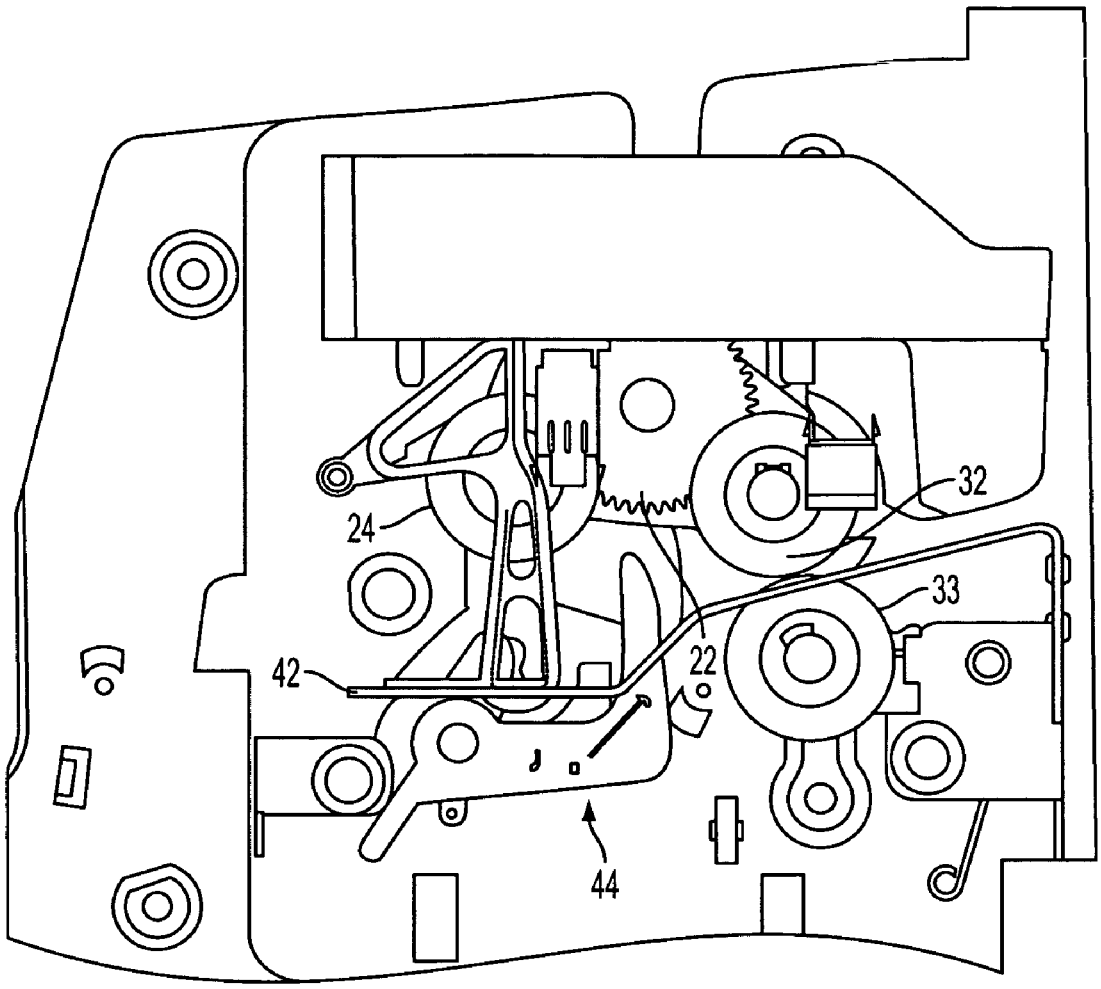
FIG. 5 is an end view of the feeder mechanism of FIGS. 2, 3 and 4 with the drive motor removed to illustrate the mechanism.

It will be understood that feeder roller 32 has a companion roller 33 disposed below the deck 40 and having the edges thereof extending through a slot forming in the deck as shown in FIG. 5.

Figure 2:
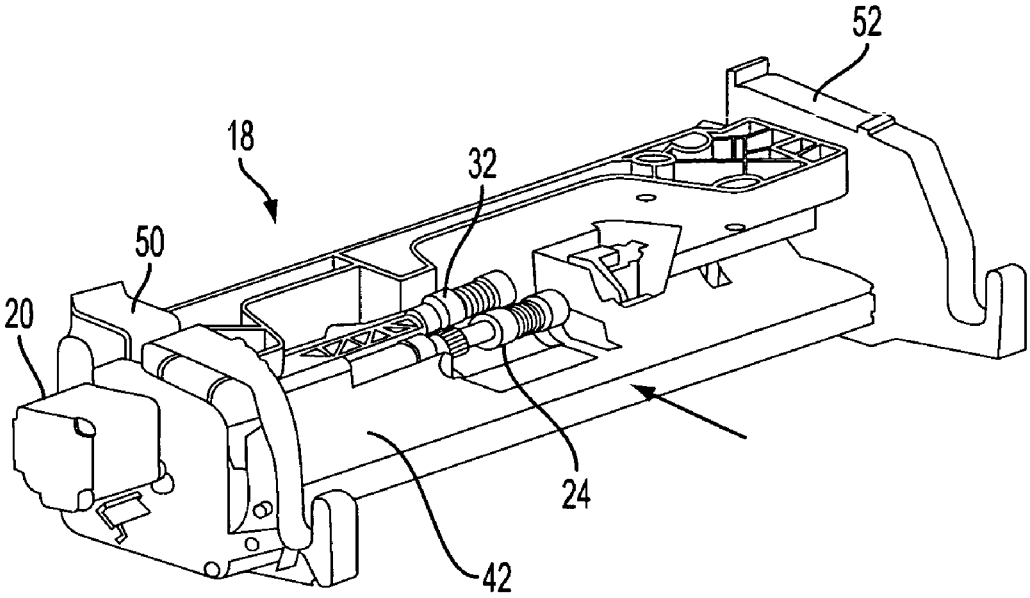
FIG. 2 is a view of the mechanism of FIG. 1 with the cover and loading tray removed.
Figure 3:
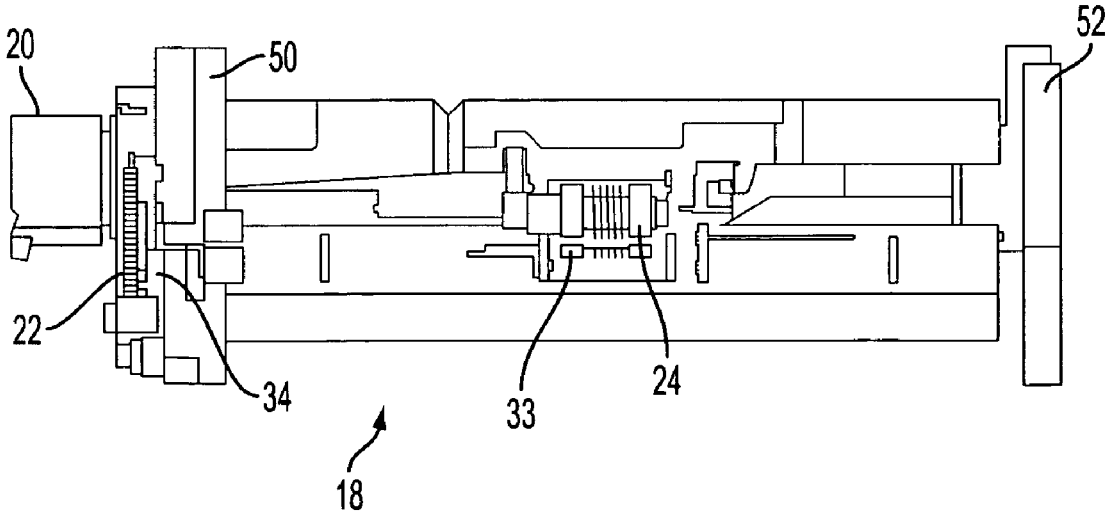
FIG. 3 is a front view of the mechanism of FIG. 2.
Figure 4:
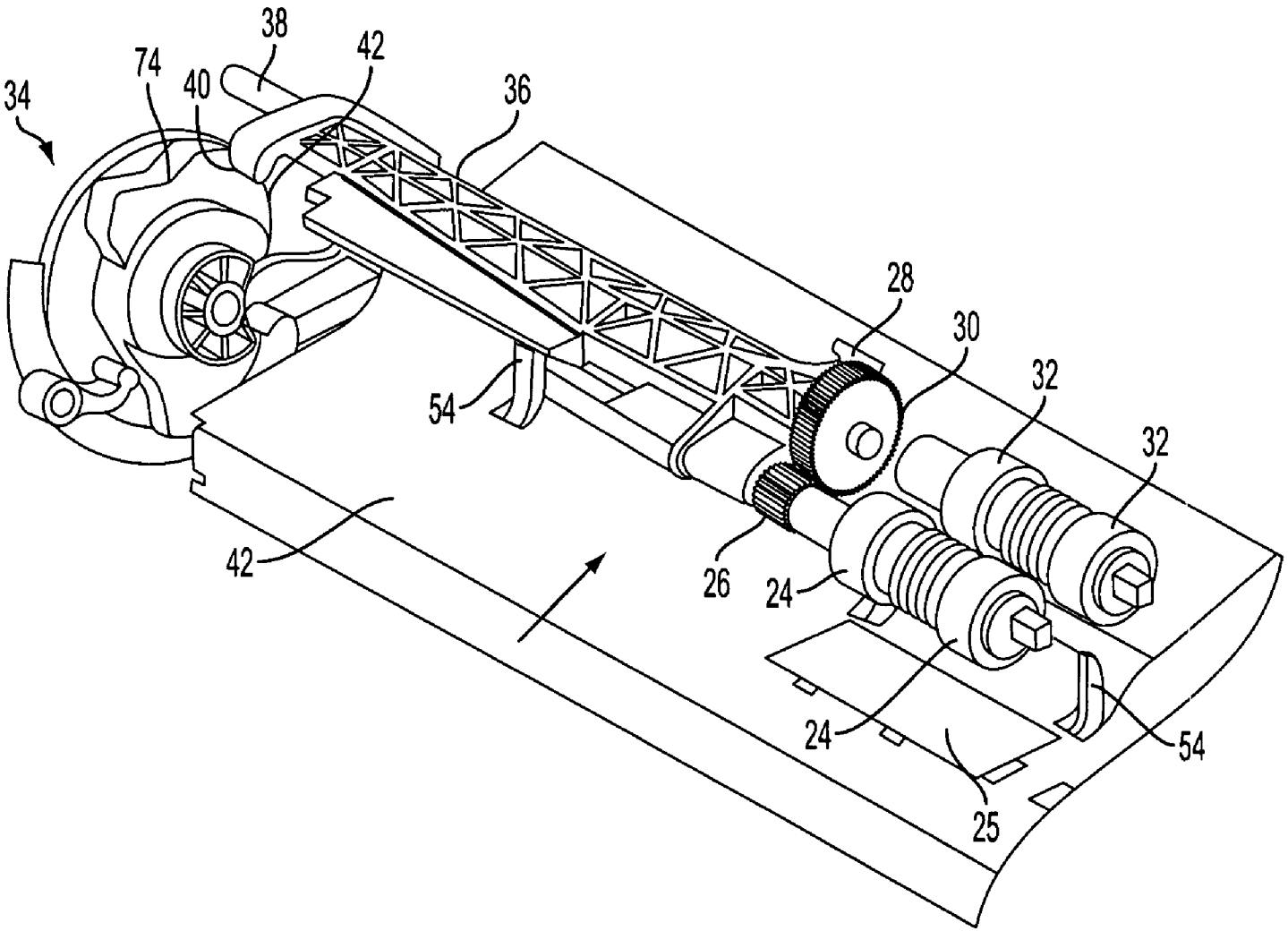
FIG. 4 is an axonometric view of the feeder mechanism of FIG. 1 with the tray and cover removed.
Figure 6:
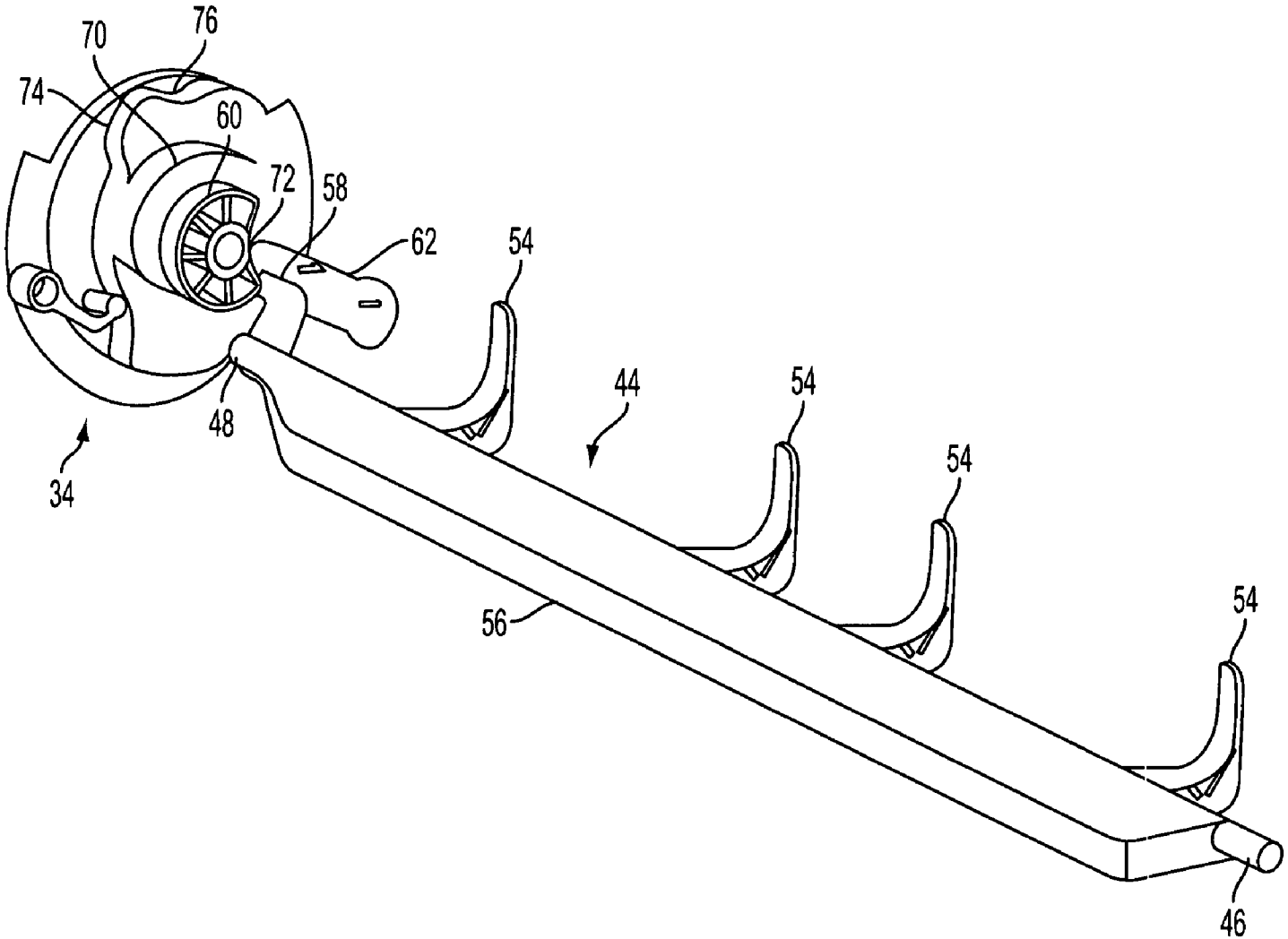
FIG. 6 is a perspective view of the sequencer and registration gate illustrating the locking lever for the gate.
Figure 7:
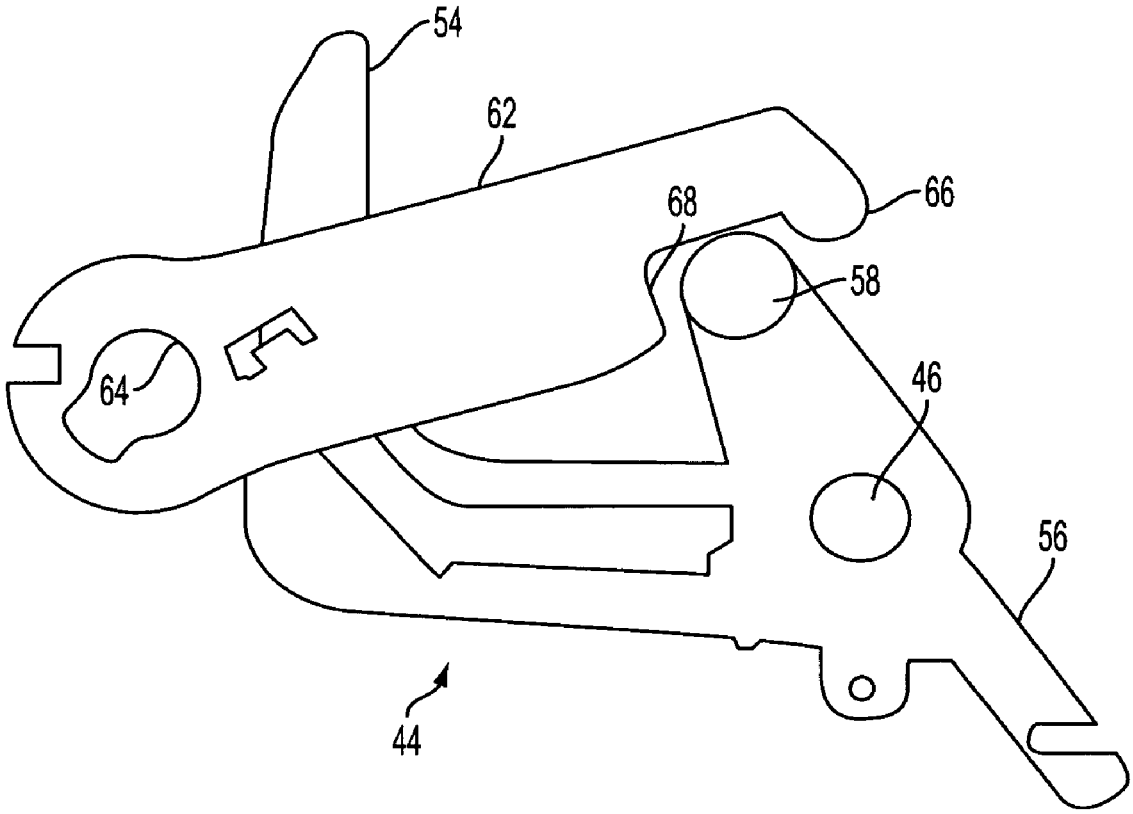
FIG. 7 is an enlarged detail of the locking lever and gate cam follower.

Referring to FIGS. 4, 5 and 6, the combination sheet stack register and gate is indicated generally at 44 and has a generally elongated configuration with a pair of half axles or hubs 46, 48 extending each from an opposite end thereof and each of which is journalled in one of the housing end sections 50, 52 (see FIGS. 2 and 3).

Gate 44 has a plurality of fingers 54 extending therefrom generally at right angles to the axis of rotation formed by the half axles 48, 46, which fingers 54 are aligned in the axial direction. The gate 44 has a stiffening rib 56 formed there along to provide the necessary rigidity to the gate for maintaining the fingers aligned during registration of the sheet stack leading edge against the fingers 54.

Rib 56*b* also serves as a stop to limit rotation of the gate about the axis through hubs 46, 48.

Gate 44 also has a cam follower 58 extending from one end thereof adjacent the half axle 48 as shown in FIG. 6.

Referring to FIGS. 6 through 15, cam 34 has a cam track 70 formed thereon which is contacted by the cam follower 58 on the gate 44, upon rotation of the cam by motor 20, pivotal movement of the gate 44 is effected as will hereinafter be described in greater detail.

A locking lever 62 is pivotally mounted on the end 50 of the feeder mechanism 18 about aperture 64 formed in one end of the lever; and, the lever 62 has a cam follower 66 formed on the end thereof opposite the aperture 64, which cam follower is operative to contact and follow cam track 60 on the cam 34. Lever 62 also has a notch 68 formed therein which is configured to engage the cam follower 58 on the gate 44 and lock the gate into a desired position. The cam track 60 has a concave portion or notch 72 formed therein into which the cam follower 66 drops thereby permitting notch 68 to engage the cam follower 58 and lock the gate 44.

Cam track 70 is also configured to have a dwell portion thereon corresponding to notch 72 to prevent the cam from attempting to lift the follower 58 when the locking lever 62 is engaging the cam follower 58.

Cam 34 has an another cam track 74 which is contacted by and followed by the cam follower 40 on the nudger 36 as shown in FIGS. 4 and 8 through 15.

The outer cam track 74 for the nudger frame cam follower 40 has a notch 76 into which a follower pawl 78 drops to detent or stop the cam 34 from rotating when the cam has rotated to the position such that the notch 76 is coincident with the end of the pawl 78.

of the gate 44 and locking the fingers 54 in the upright position for registering the leading edge of the sheets in the loading tray 14.

Figure 8:
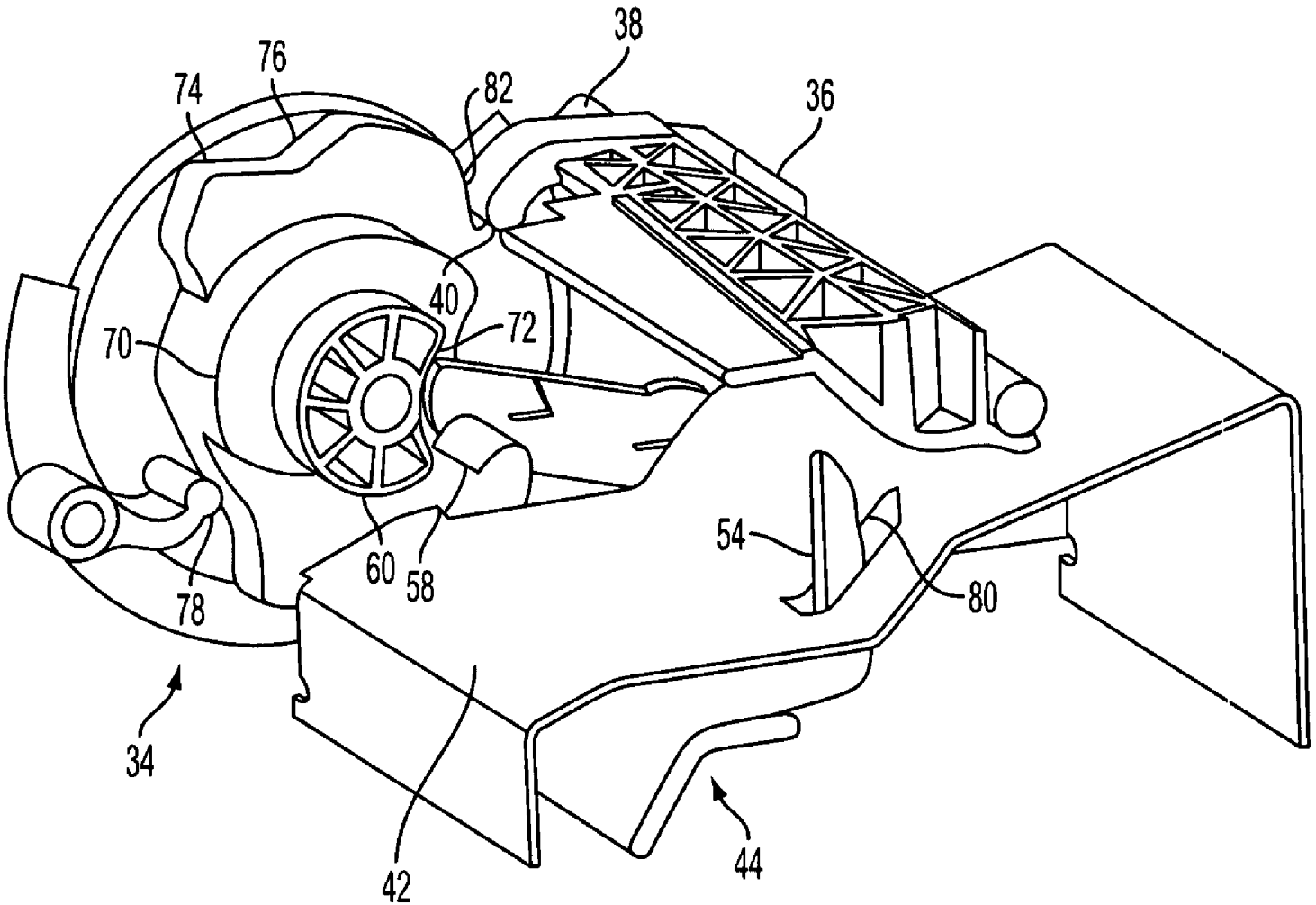
FIGS. 8-15 are perspective views of the sequence gate and nudger operation during rotation of the cam through one revolution.
Figure 9:
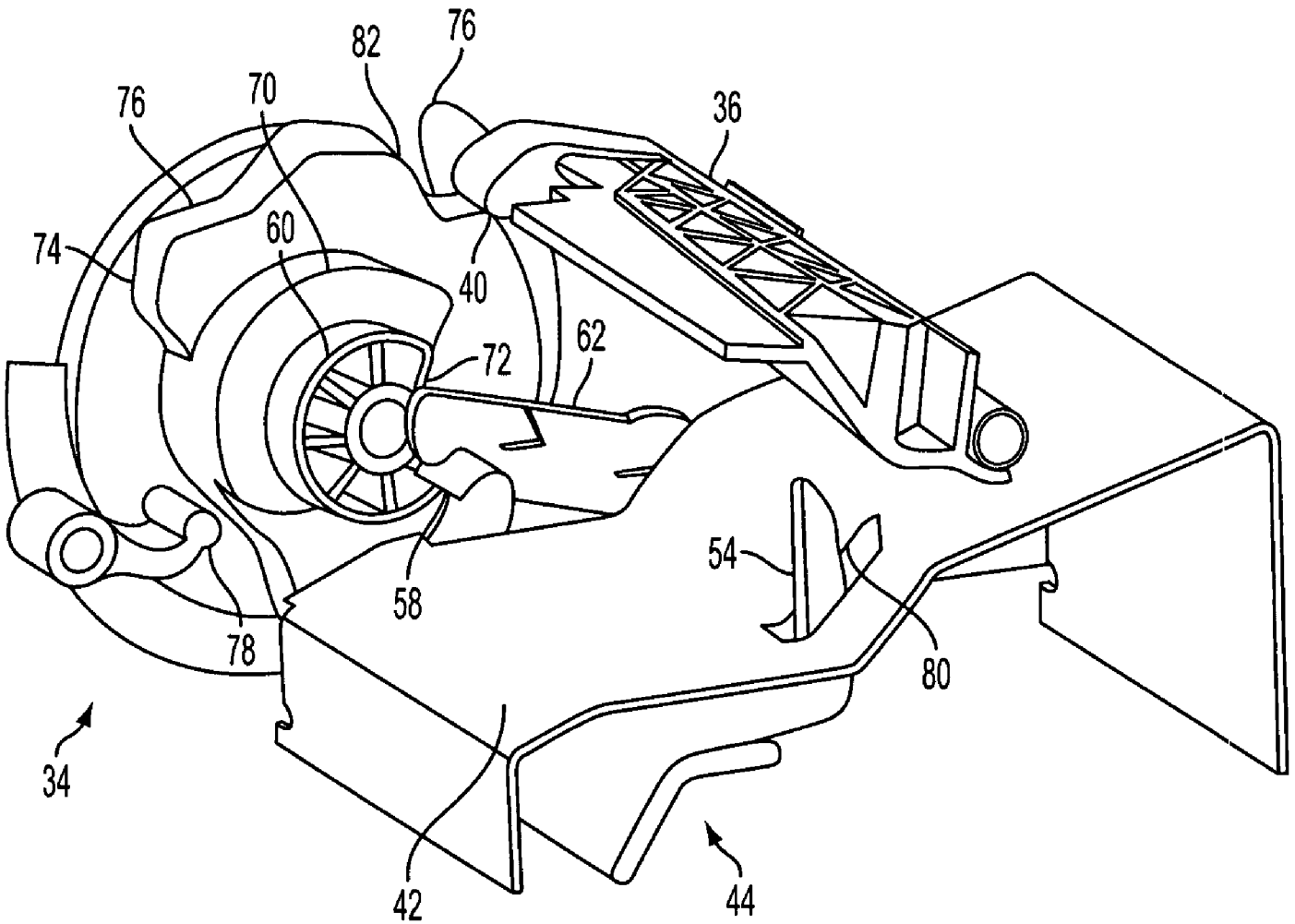

Referring to FIG. 9 and Table 1, the cam 34 has been rotated in a counterclockwise direction by an amount of about 25° with respect to the position shown in FIG. 8; and, in the position shown in FIG. 9, the locking lever 62 has remained in the locking position with notch 68 engaging the cam follower 58 for the gate 44 retaining the gate fingers 54 in the upright sheet registration position. However, cam follower 40 on the nudger frame 36 has caused the nudger frame to be lifted from the deck 42.

Figure 10:
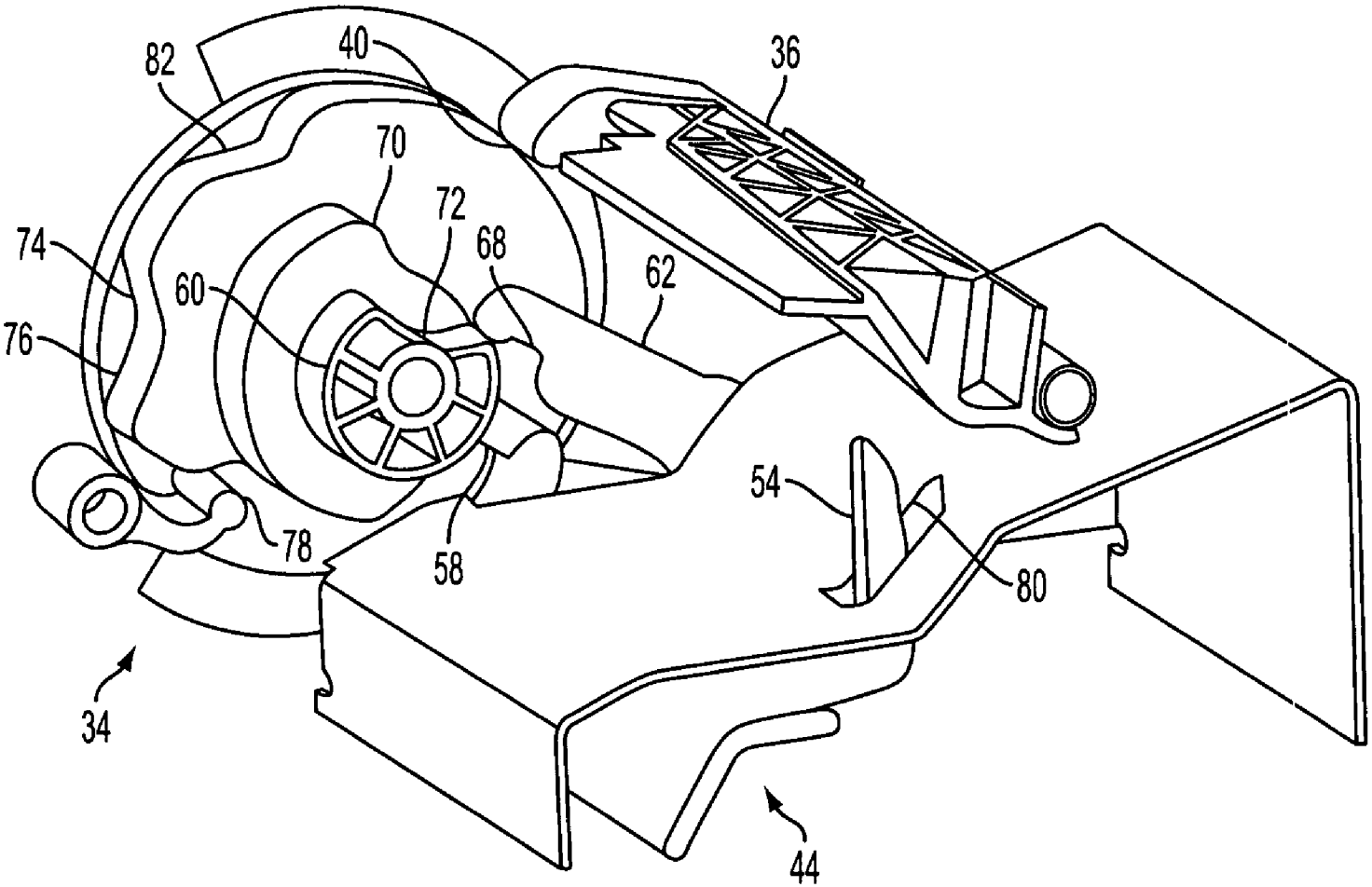

Referring to FIG. 10 and Table 1, the cam 34 has been further rotated counterclockwise to a position of about 70° from the position of FIG. 8; and, in the position shown in FIG. 10, nudger frame cam follower 40 is maintained lifted. The locking lever 62 has been lifted from gate cam follower 58 with the gate fingers 54 remaining in the vertical position.

Figure 11:
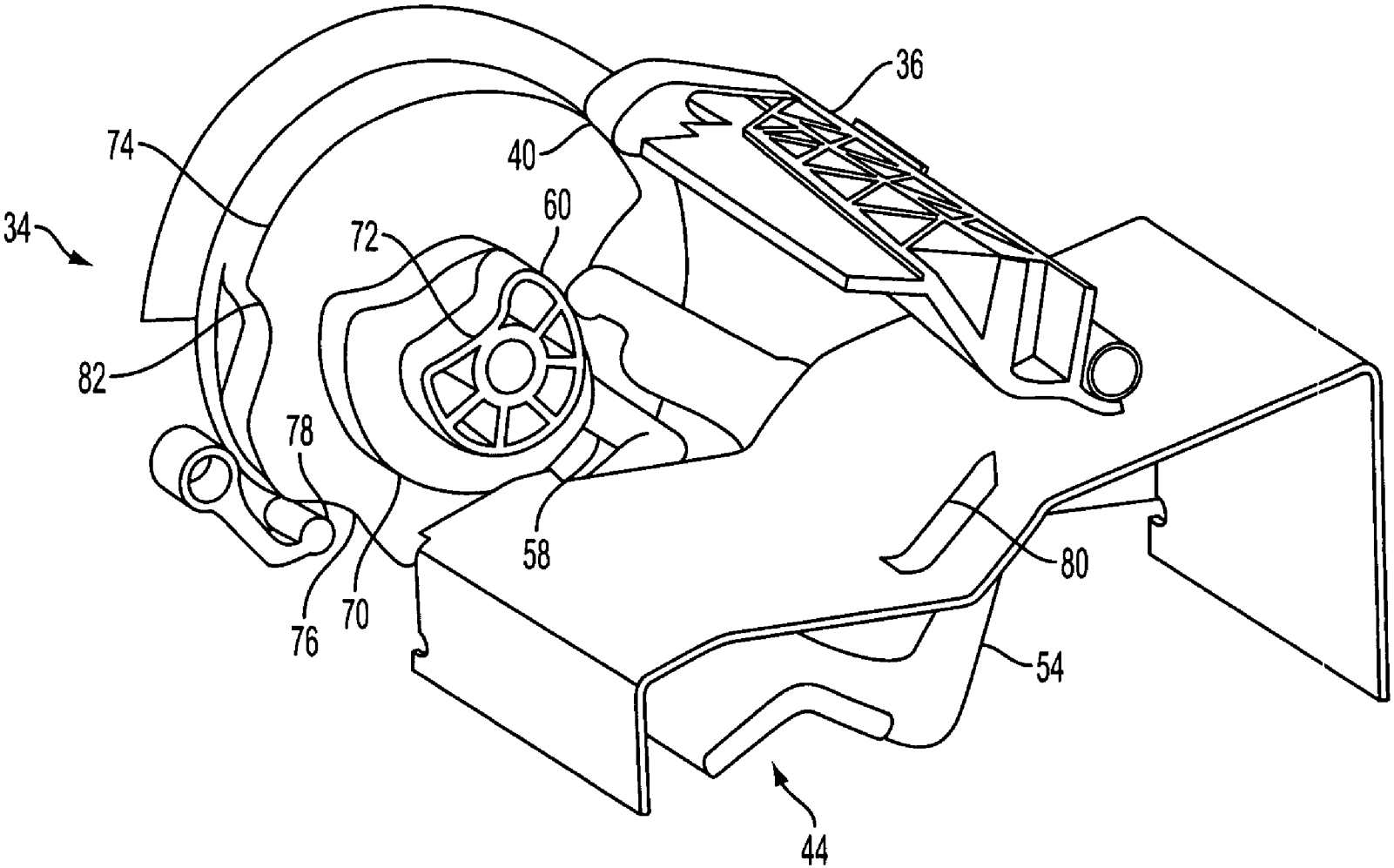

Referring to FIG. 11 and Table 1, cam 34 has been rotated further in a counterclockwise direction to a position making an angle of about 120° with the starting position of FIG. 8; and, in the position shown in FIG. 11, the cam follower 58 has been moved to a position rotating the gate 44 in a clockwise direction causing the fingers 54 to be retracted through the slots 80 to a position below deck 42 in preparation for feeding the sheets from the stack. The cam track 74 has maintained the cam follower 40 for the nudger frame 36 in the lifted position shown.

Figure 12:
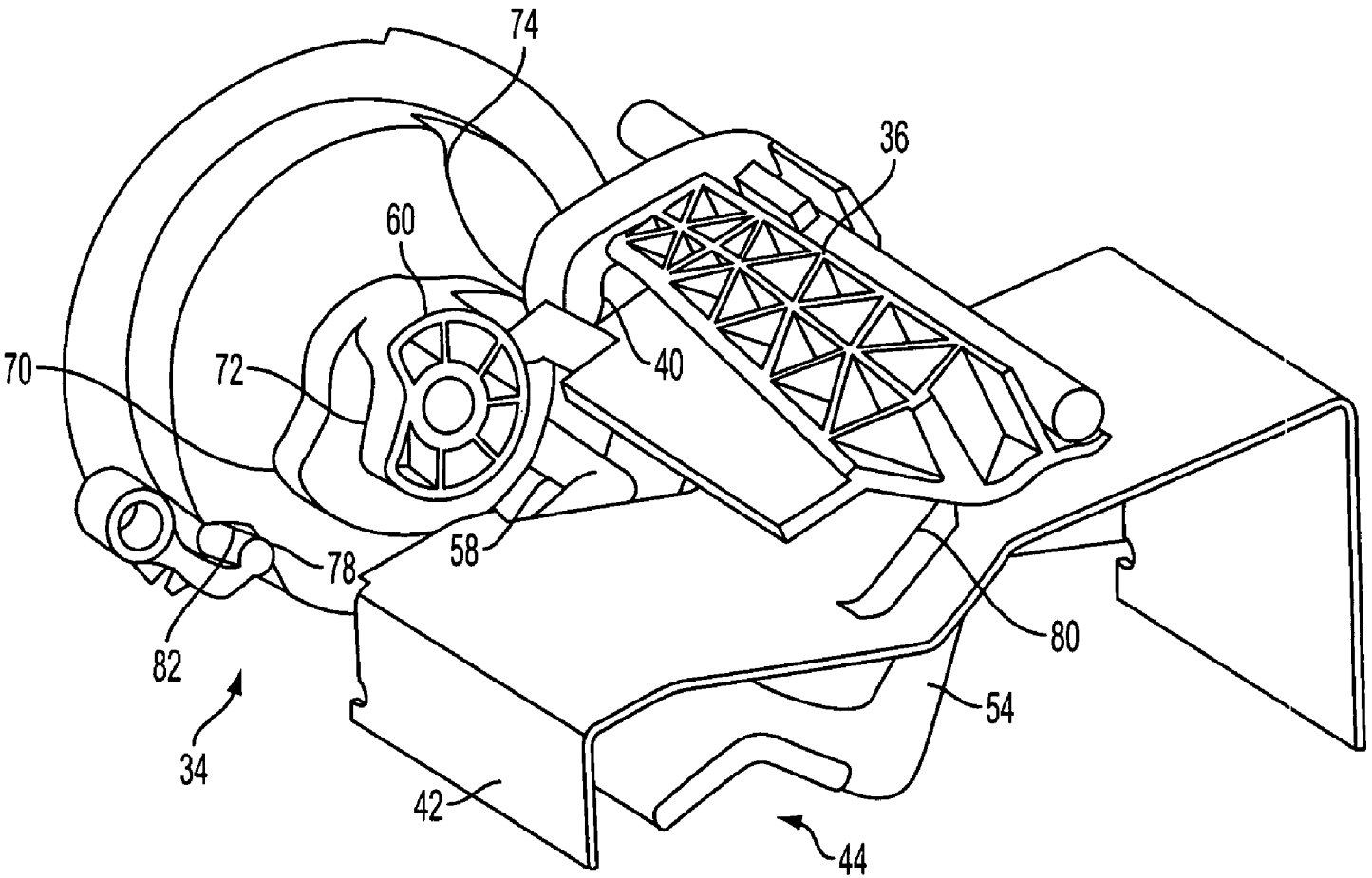

Referring to FIG. 12 and Table 1, the cam 34 has been rotated further in a clockwise direction to a position of about 180° from the starting position shown in FIG. 8; and, in the position shown in FIG. 12, the cam track 70 maintains the cam follower 58 rotated in the clockwise position to hold the gate fingers 54 below deck 42; and, cam track 74 has permit-

TABLE I

| CAM POSITION | USER | NUDGER FOLLOWER | FEEDER OPERATES | GATE | GATE LOCKING LEVER ENGAGED | CAM LOCKING PAWL ENGAGED |
|---|---|---|---|---|---|---|
| 0° | LOADS TRAY | LOAD NOTCH | NO | CLOSED | YES | NO |
| 25° | — | LIFTED | NO | CLOSED | YES | NO |
| 70° | — | LIFTED | NO | CLOSED | NO | NO |
| 120° | — | LIFTED | NO | OPEN | NO | NO |
| 180° | — | LOWERED | YES | OPEN | NO | YES |
| 270° | — | JAM CLEAR NOTCH | NO | OPEN | NO | NO |
| 325° | — | LIFTED | NO | CLOSED | NO | NO |
| 360° | LOADS TRAY | LOAD NOTCH | NO | CLOSED | YES | NO |

Referring to FIG. 8 and Table 1, the cam 34 is in the 0° position wherein the gate 44 is rotated to a position wherein each of the fingers 54 extends upwardly through a slot 80 formed in deck 42 to a generally vertical position for serving as a leading edge register for sheet stock loaded into the tray 14 between the guides 16. The nudger frame 36 is lifted by virtue of cam follower 40 contacting a lifting portion of cam track 74. In the cam position shown in FIG. 8, the cam follower 40 on the nudger frame is dropped into a loading notch 82 formed in a cam track 74.

The cam track 60 has the concave portion 72 thereof positioned adjacent the end of the cam follower 66 on the end of lever 62 to permit the lever to drop such that notch 68 engages the cam follower 58 on the gate 44 thereby preventing rotation ted the follower 40 on the nudger frame 36 to lower the nudger into a position for sheet feeding. In this position shown in FIG. 12, the feeding mechanism is then operated. The notch 82 on the cam track 74 has permitted the pawl 78 to drop therein thus detenting or locking cam 34 in the feed position shown in FIG. 12.

Figure 13:
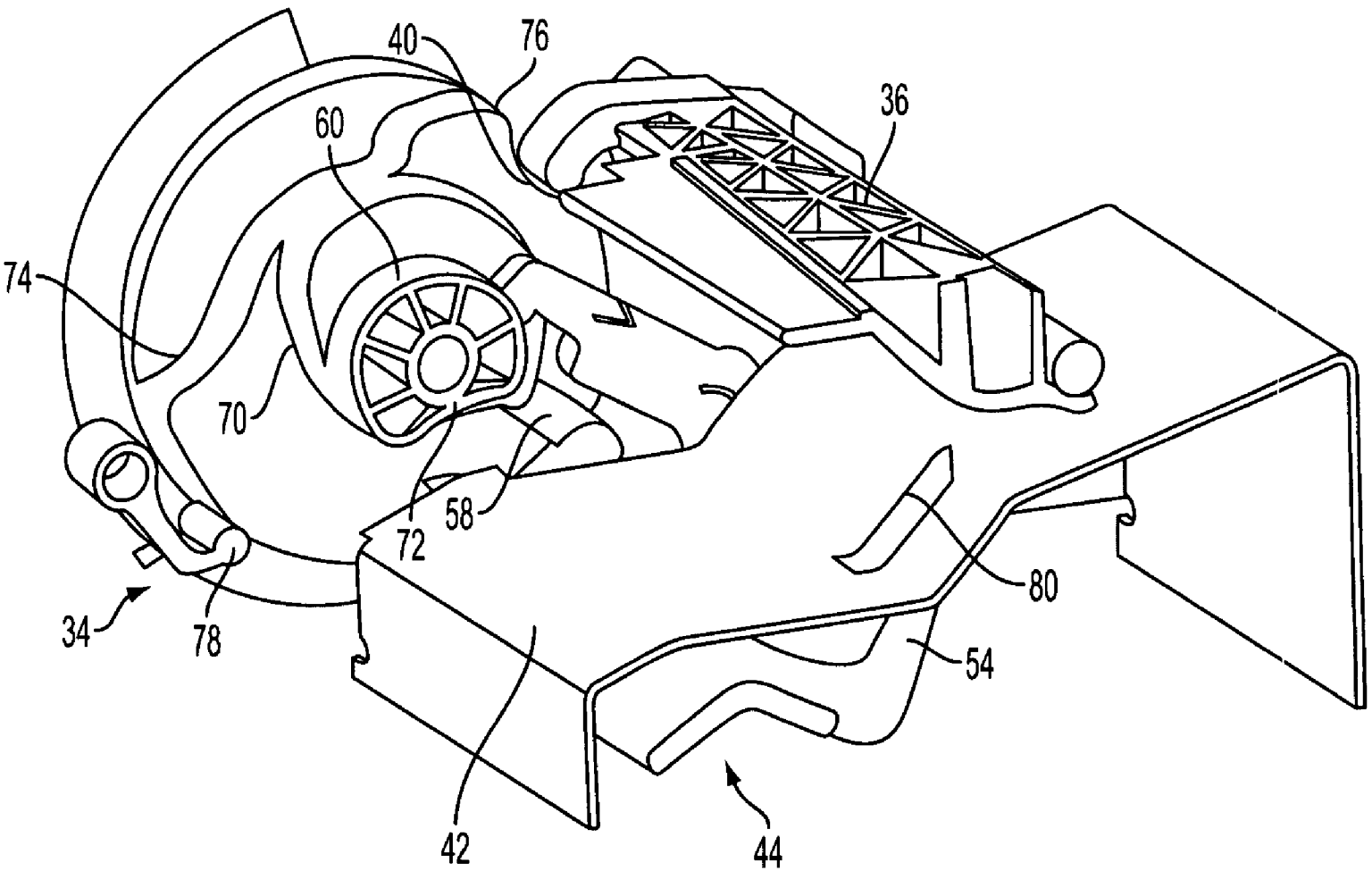

Referring to FIG. 13 and Table 1, cam 34 has been further rotated in a counterclockwise direction to a position of about 270° from the starting position of FIG. 8; and, in the position shown in FIG. 13, cam track 74 maintains follower 40 in a lifted no position to lift the nudger frame from the operating position with gate fingers 54 remaining below deck 42 in the open position and the locking pawl 78 has been lifted from notch 82. The follower 40 is shown dropped in the notch 76 on cam 74. The position shown in FIG. 13 thus permits clearing of any sheet which may be jammed in a feeding mechanism.

Figure 14:
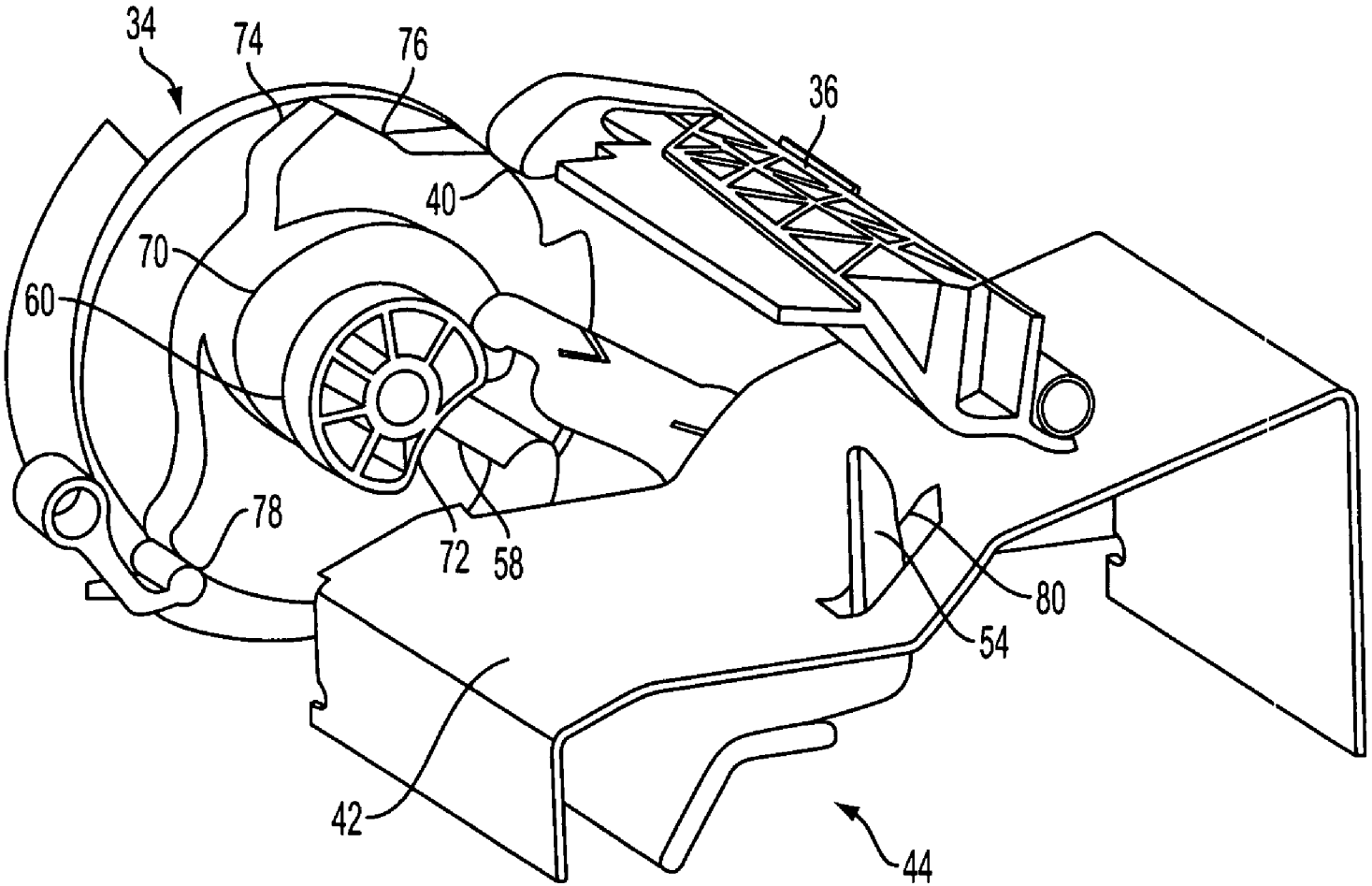

Referring to FIG. 14 and Table 1, the cam has been rotated counterclockwise by an amount of about 325° with respect to the position shown in FIG. 8; and, in the position shown in FIG. 14, the nudger cam follower 40 and nudger frame 36 have been lifted and the feeder is not in operation. The cam follower 58 has been permitted to move into the concave region 72 of cam 60 thereby rotating the gate 44 in a counterclockwise direction turning the fingers 54 upwards through slots 80 in the deck 42 to the vertical registration position.

Figure 15:
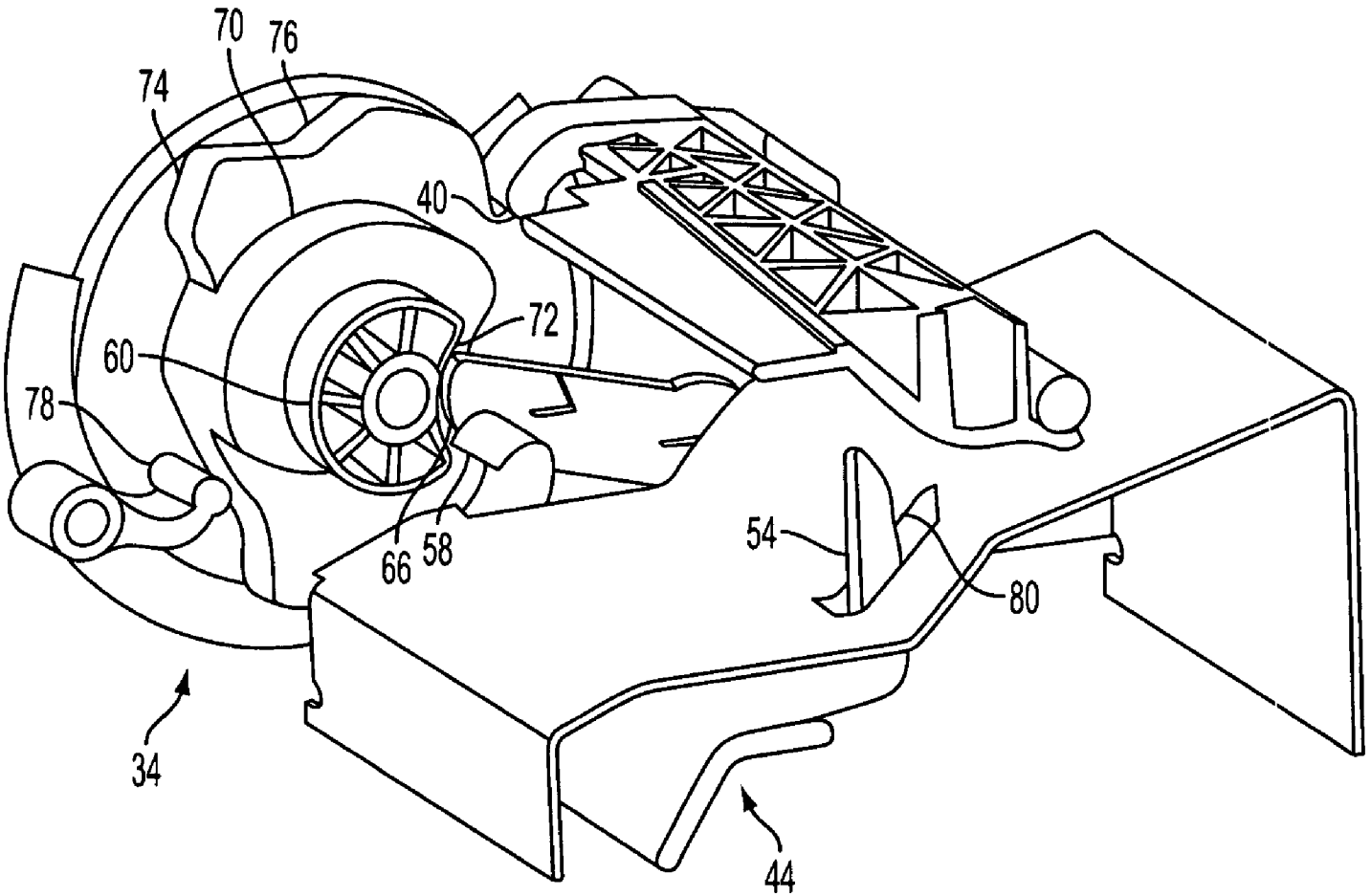

Referring to FIG. 15 and Table 1, cam 34 has now been rotated in the counterclockwise direction an amount to return to the starting position of FIG. 8; and, the locking lever follower 66 has been permitted to drop into the concave region 72 of cam track 60 and notch 68 of lever 62 engages the gate cam follower 58 to maintain the fingers 54 in the upward registration position. It will be understood that the mechanism in the position in FIG. 15 is now ready for sheet loading by the user.

The pawl 78, lever 62, gate cam follower 58 and nudger frame follower 40 may be biased in a direction toward contacting the cam, if desired, by suitable springs, omitted from the drawings for the sake of clarity of illustration.

The feeder mechanism of the present disclosure has been described hereinabove with respect to the exemplary embodiment illustrated in the drawings and provides for a rotating gate which, in the closed position, serves as a registration surface for the leading edge of the sheets in a user loaded stack and serves to minimize any skewing of the sheets in the loading tray. In preparation for feeding of the sheets from the stack, the gate is rotated to a position wherein the registration fingers are retracted through slots in the deck supporting the sheets as they enter the nudger and feeder. The present disclosure thus describes a simple, effective and relatively low cost technique for addressing the problem of aligning sheets in a stack loaded by the user into a stacking tray and, particularly, for sheets to be automatically fed into a printer.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of providing a registration surface for the leading edge of sheet stack in a sheet feeder comprising:

(a) latching a gate of a receptacle in a closed position by moving a locking member with a cam during loading of a sheet stack to be fed;

(b) disposing the gate for pivotal movement about an axis positioned at a right angle perpendicular to the direction of sheet feed; and (c) rotating the gate by rotating the cam, moving an adjoining cam follower, and moving the locking member by engaging a locking surface on the gate, where the gate is rotated between a closed position blocking sheet feed from the stack and serving as a registration surface for user sheet loading and an open position permitting sheet feed, wherein the rotating includes rotating the gate in one direction by rotating a cam and rotating the gate in the opposite direction with continued cam rotation in one direction; and (d) latching the cam to prevent movement during sheet feeding.

2. A method of providing a registration surface for the stack of sheets into a sheet feeder comprising:

(a) positioning a cam at a start position of zero degrees, wherein a series of fingers are extended upward through slots in a deck, with a nudger frame lifted, and a cam follower attached to the nudger frame is dropped into a load notch formed in a cam track and where a lever drops into a notch on the cam follower, which prevents a gate from rotating, (b) rotating the cam to a position approximately 25 degrees from the start position, wherein the nudger frame is lifted from the deck;

(c) rotating the cam at a position approximately 70 degrees from start, wherein a locking lever is lifted from the gate cam follower;

(d) rotating the cam at a position approximately 120 degrees from start, wherein a second cam follower moves to a position which rotates the gate and retracts the fingers through the slots into deck below;

(e) rotating the cam at a position approximately 180 degrees from start, wherein the cam follower lowers the nudger frame and a pawl drops to lock the cam in a feed position;

(f) rotating the cam at a position approximately 270 degrees from start, wherein the cam follower is dropped into a notch in the cam;

(g) rotating the cam at a position approximately 325 degrees from start, wherein the cam follower and the nudger frame are lifted and the series of fingers are extended upward through the slots in the deck;

(h) rotating the cam at a position approximately 360 degrees from start returned to the original start position in (a); and (i) the paper is loaded by the user.

3. The method of claim 2, wherein step (a) further comprises the user loads the tray, the feeder does not operate, the gate is closed, the gate locking lever is engages and the cam pocking pawl is not engaged.

4. The method of claim 2, wherein step (b) further comprises the nudge follower is lifter, the feeder does not operate, the gate is closed, the gate locking lever is engages and the cam pocking pawl is not engaged.

5. The method of claim 2, wherein step (c) further comprises the nudge follower is lifted, the feeder does not operate, the gate is closed, the gate locking lever is not engages and the cam pocking pawl is not engaged.

6. The method of claim 2, wherein step (d) further comprises the nudge follower is lifted, the feeder does not operate, the gate is open, the gate locking lever is not engaged and the cam pocking pawl is not engaged.

7. The method of claim 2, wherein step (e) further comprises the nudge follower is lowered, the feeder operates, the gate is open, the gate locking lever is not engaged and the cam pocking pawl is engaged.

8. The method of claim 2, wherein step (f) further comprises the nudge follower is at a jam clear notch position, the feeder does not operate, the gate is open, the gate locking lever is not engages and the cam pocking pawl is not engaged.

9. The method of claim 2, wherein step (g) further comprises the nudge follower is lifted, the feeder does not operate, the gate is closed, the gate locking lever is not engaged and the cam pocking pawl is not engaged.

10. The method of claim 2, wherein step (h) further comprises the user loads the tray, the feeder does not operate, the gate is closed, the gate locking lever is not engaged and the cam pocking pawl is not engaged.

11. The method of claim 2, wherein step (a) and step (h) are identical.

12. A system for loading sheets in a sheet feeder comprising:

a receptacle for stacking loaded sheets to be fed;

a nudger operable for receiving a sheet from the stacks to the feeder; introducing a sheet;

a gate disposed for rotation with respect to the feeder;

a series of fingers attached to the gate;

a deck containing a series of holes; through which the series of fingers extend and retract;

a latch member operably responsive to the cam for locking the gate in the closed position;

a cam disposed for rotational movement about an axis perpendicular to the direction of the sheet feed; and a cam follower formed integrally with the cam and operably responsive to the cam rotation to effect the pivotal movement of the gate between an open position permitting sheets to be fed from the stack and a closed position blocking movement of the sheets from the stack, wherein the gate in the closed position serves as a leading edge register for loading sheets.

* * * * *